US006604315B1

(12) United States Patent
Smith et al.

(10) Patent No.: US 6,604,315 B1
(45) Date of Patent: Aug. 12, 2003

(54) METHOD AND APPARATUS FOR MAINTAINING PROPER ORIENTATION OF AIMING EYE WHEN FIRING SHOTGUN

(76) Inventors: Cleveland C. Smith, 412 Albert, Helena, MI (US) 59601; Jadin C. Jackson, 1312 Gibbs Ave., St. Paul, MN (US) 55108

( * ) Notice: Subject to any disclaimer, the term of this patent is extended or adjusted under 35 U.S.C. 154(b) by 0 days.

(21) Appl. No.: 10/231,951

(22) Filed: Aug. 30, 2002

Related U.S. Application Data

(63) Continuation-in-part of application No. 09/792,223, filed on Feb. 23, 2001, now abandoned.

(51) Int. Cl.[7] ..... F41G 1/00

(52) U.S. Cl. ..... 42/112; 42/137; 42/111; 42/144

(58) Field of Search ..... 42/112, 137, 111, 42/144; 89/41.19; 434/20

(56) References Cited

U.S. PATENT DOCUMENTS 1,222,620 A * 4/1917 Gaynor et al. ..... 42/137
2,553,540 A * 5/1951 Beckerman ..... 42/144
3,362,074 A * 1/1968 Luebkeman et al. ..... 42/144
3,565,539 A * 2/1971 Russa ..... 356/251
3,911,607 A * 10/1975 Luebkeman ..... 42/129
3,912,400 A * 10/1975 Luekbkeman ..... 356/247
4,070,763 A * 1/1978 Carts, Jr. ..... 42/132
4,614,039 A * 9/1986 Kafri et al. ..... 42/132
4,616,421 A * 10/1986 Forsen ..... 42/130
4,745,698 A * 5/1988 Schwulst ..... 42/132
5,101,589 A * 4/1992 Duncan ..... 42/71.02
5,471,777 A * 12/1995 McDonald ..... 42/132
5,953,165 A * 9/1999 Stolov ..... 359/834
6,321,479 B1 * 11/2001 Sheehan ..... 42/111

* cited by examiner

*Primary Examiner*—Michael J. Carone
*Assistant Examiner*—M. Thomson
(74) *Attorney, Agent, or Firm*—Todd N. Hathaway

(57) ABSTRACT

A method and apparatus for assisting a shooter in holding an aiming eye at a predetermined level relative to the barrel of a shotgun. Light is reflected or projected along a path extending at a predetermined rearward, so that the shooter's aiming eye receives a first image when it is at the proper level and a second image when it is above the proper level, thus indicating to the shooter when the aiming eye has been raised too high. The images may be different colors, produced by dispersing the beam by reflecting it from a diffraction grating or passing it through a prism. A lenticular sheet may also be used to create different colors or images that are received above and below the dividing plane. Moirè patterns may also be used to produce an image that shifts with movement of the aiming eye. A visual warning may also be provided for indicating when the shooter's aiming eye has moved from proper alignment with the barrel in azimuth or when the non-aiming eye is exerting cross-dominance over the aiming eye.

8 Claims, 8 Drawing Sheets

METHOD AND APPARATUS FOR MAINTAINING PROPER ORIENTATION OF AIMING EYE WHEN FIRING SHOTGUN

This application is a continuation-in-part of application No. 09/792,223 filed on Feb. 23, 2001 now abandoned.

BACKGROUND OF THE INVENTION

The present invention relates generally to sighting aids for shotguns, and, more particularly, to a method and apparatus that aids a shooter in maintaining the aiming eye at a proper elevation relative the rib and bead of a shotgun.

RELATED ART

Shotgun sights differ significantly from the sights used on rifles and other firearms. Since a shotgun fires a pattern of pellets rather than a single slug, speed of aiming and pointing are generally more important than precise accuracy. For example, bird hunting, and trap shooting both demand aiming at comparatively close, fast-moving targets, as opposed to rifle shooting, where the target is usually at a longer range and the angular rate of movement is much slower.

Because of these different requirements, the sights used on other types of long arms are generally unsuitable for shotguns. For example, conventional iron sights for rifles generally have an open or"peep" rear sight on the receiver and a bead at the muzzle end of the barrel, the goal being to achieve very precise alignment in both elevation and azimuth. However, this arrangement requires comparatively slow and deliberate aiming, and moreover the sight picture is comparatively small, so that these types of sights are generally ill suited for use on shotguns. Telescopic rifle sights can achieve even greater accuracy, but for similar reasons they too are unsuitable for use on shotguns (except for deer hunting and other specialized applications where the gun fires a single slug as opposed to a pattern of pellets).

Shotgun sights, by contrast, ordinarily lack a rear sight aperture. Instead, there is usually a rib along the top of the barrel (or between the barrels in the case of a side-by-side), with a small bead being mounted at the forward end of the rib. Although this arrangement permits extremely fast and effective aiming when firing at close, fast moving targets, it does present certain challenges that can be very difficult to master.

One particular difficulty is that of maintaining the aiming eye at the proper level relative to the barrel. Since there is no rear sight opening to look through, proper elevation of the barrel depends on the user keeping his aiming eye closely level with the rib, usually with the cheek held against the stock and the eye looking just over the top of the receiver. However, this is easier said than done; similar to the situation with a golf swing, there is a recurring tendency for the shooter to lift his head and raise his eye above the proper level. As the shooter raises his head, there is a tendency to raise the front bead as well, with the result that the barrel is elevated too high and the shot misses the target.

To illustrate this situation, FIG. 1 shows a shotgun 01 having conventional sights, consisting up of a rib 02 that extends along the top of the barrel 03 and a front bead 04 that is mounted proximate the forward end of the barrel. As noted above, proper aiming requires that the sighting eye be held essentially level with the rib 02, looking forward over the top of the receiver 05. However, as can be seen in FIG. 2, inadvertent lifting of the head causes the aiming eye 06 to be raised above the proper level, so that when the front bead 04 its positioned on the line of sight 07 from the eye to the target 08 the barrel is in fact angled too high and the shot passes over the target, as indicated by arrow 09.

This is an extremely common problem, and is perhaps most pronounced when firing multiple shots in quick succession, since the first shot tends to break the shooter's concentration and the recoil also causes the gun to move rearwardly and downwardly relative to the aiming eye. As a result, shooters constantly have to remind themselves to keep their heads down, but in the absence of an effective visual reference it is in fact very difficult to keep the aiming eye at the proper level under such circumstances.

A great many types of sights have, of course, been used or proposed over the long history of firearms. However, the vast majority have been variations on the typical arrangement of front and rear sights used on rifles, usually with the goal of achieving precision accuracy. Most are therefore unsuitable for shotgun use. Consequently, the problem of keeping the aiming eye at the proper level relative to the rib of a shotgun has remained unresolved.

Another, somewhat related difficulty is that of cross dominance, wherein the non-sighting eye becomes dominant and the barrel becomes misaligned in the direction of azimuth. This is due to the fact that the non-aiming eye is not in direct vertical alignment above the aiming eye when the head is held in a normal aiming position. Thus, if the non-aiming eye becomes dominant there is a tendency for the shooter to inadvertently aim to one side or the other of the target; for example, if the shooter is aiming with the right eye and the left eye becomes dominant, there will be a tendency to shoot to the left of the target, due to the different angular positions of the two eyes.

Yet another limitation of conventional shotgun sights stems from the comparatively rapid angular movement of the target. As has been described above, conventional rib-and-bead sights allow for rapid acquisition of a fast-moving target. However, the rapid movement of the target also means that the shooter must "lead" the target by aiming along its projected path, and conventional sights provide little or nothing in the way of a visual reference by which the shooter can accurately judge the line of flight and thereby determine a proper lead angle.

Accordingly, there exists a need for a method and apparatus for assisting a shooter in maintaining his aiming eye at the proper elevation relative to the rib and front bead when using a shotgun. Furthermore, there exists a need for such a method and apparatus that does not interfere with the ability of the shooter to rapidly acquire the target and point the shotgun when using rib-and-bead sights. Still further, there exists a need for such a method and apparatus that provides the shooter with a distinctive and virtually instantaneous indication when his eye has been raised above the proper level, so that the shooter is able to reposition his head in a quick and reflexive manner. Still further, there exists a need for such a method and apparatus that encourages proper side-to-side alignment of the sighting eye and also inhibits cross-dominance by the non-sighting eye. Still further, there exists a need for a method and apparatus that assists the shooter in determining the flight angle of targets so as to determine the proper angle of the lead. Still further, there exists a need for such a method and apparatus that is lightweight and simple in construction, and which does not encumber the shotgun or impair its handling. Still further, there exists a need for such a method and apparatus that is sufficiently reliable to be used in a field environment, and that is sufficiently inexpensive to manufacture that it can be made widely available to shooters and hunters.

SUMMARY OF THE INVENTION

The present invention has solved the problems cited above, and is a method for assisting a shooter with holding an aiming eye at a predetermined proper orientation relative to the barrel of the shotgun.

The method may comprise the steps of forming a visual display, and presenting the display to the aiming eye along a path that extends at a predetermined rearward angle over the barrel such that at a predetermined longitudinal position of the aiming eye the path is at the proper level for the aiming eye to be held relative to the barrel, so that in response to being lifted above the path, the aiming eye sees a change in image that provides the shooter with a visual indication that the aiming eye has been raised above the proper level relative to the barrel.

In a preferred embodiment, the step of presenting the display may comprise projecting light from a forward portion of the barrel towards the predetermined position of the aiming eye. The step of projecting light from a forward portion of the barrel may comprise reflecting light from a refractive surface so as to disperse the light into at least two different colors, so that a first color is received by the aiming eye when aligned with the path and a second color is received by the aiming eye when raised above the path. The step of reflecting light from a refractive surface may comprise reflecting light from a diffraction grating on the barrel so that at least a partial spectrum is projected along the path towards the aiming eye.

The step of projecting light from a forward portion of the barrel may also comprise projecting light from a lenticular sheet on the barrel, so that a first projected image is received by the aiming eye when aligned with the path and a second projected image is received by the aiming eye when raised above the path.

The step of projecting light from a forward portion of the barrel may also comprise projecting light from overlapping repetitive patterns on the barrel so as to generate a moirè effect, so that a first moirè pattern is received by the aiming eye when aligned with the path and a second moirè pattern is received by the aiming eye when raised above the path.

The step of projecting light from the forward portion of the barrel may also comprise reflecting light from at least one mirror surface, so that the reflected light is received by the aiming eye when on a first side of the path and is not received by the aiming eye on an opposite side of the path. This step may also comprise providing at least one substantially planar surface having a contrasting color or reflective surface thereon, with the planar surface extending at an angle substantially in alignment with the path to the aiming eye, so that the contrasting color or reflection is not visible to the aiming eye when aligned with the path and becomes visible to the aiming eye when the eye is raised above the path.

The step of forming the display may comprise reflecting light from an ambient source or may comprise projecting a beam of light from an artificial source. The artificial light source may be an LED, or may be a lighted sight tube.

The step of presenting a visual display may comprise dispersing a beam of light into at least two different colors so that a first color received by the aiming eye when aligned with the path and a second color is received by the aiming eye when above the path. The step of dispersing the beam of light into different colors may comprise reflecting a beam of light from a diffraction grating so as to disperse the beam into at least a partial spectrum that is projected along a path towards the aiming eye. The step of reflecting a beam of light on a diffraction grating may comprise projecting a beam of light forwardly against the front sight of the shotgun, and reflecting the forwardly projected beam of light from a concave diffraction grating on the rearward side of the sight.

The step of dispersing the beam of light may also comprise passing a beam of light through a prism so as to disperse the beam into at least a partial spectrum that is projected along the path towards the aiming eye. The step of passing a beam of light through the prism may comprise projecting a beam of light rearwardly from proximate the front sight of the shotgun, and passing the rearwardly projected beam through a prism mounted along the barrel of the shotgun so as to be positioned between a front sight and the aiming eye.

The step of forming a display may also comprise gathering ambient light with at least one fiber-optic rod on the forward portion of the barrel. The step of presenting the visual display may comprise positioning an end surface of at least one fiber optic rod or pair of fiber-optic rods at an angle substantially in alignment with the path to the aiming eye, so that light projected at the end surface of the fiber-optic rod is not visible to, the aiming eye when the eye is aligned with the path, and the light becomes visible when the eye is raised above the path.

The step of presenting the visual display to the aiming eye may further comprise presenting the display so that a first image is seen by the aiming eye when in proper alignment with the barrel in azimuth, and a change in the image is seen by an eye when not in proper alignment with the barrel, so that the change in image provides the shooter with a visual indication that the aiming eye has been moved from proper alignment with the barrel in azimuth or of cross dominance by the non-aiming eye.

The step of presenting the visual display to the aiming eye may further comprise presenting the display so that an indication of elevational and azimuth alignment may be ascertained simultaneously. In a preferred embodiment, the step of presenting the display for conjunctive elevational and azimuth alignment may comprise two substantially planar lenticular or diffractive surfaces on the forward portion of the barrel, such that the optical features of their lenses are orthogonally oriented to provide an indication of alignment in mutually orthogonal directions, one lenticular surface displaying a visual change when the elevation of the sighting eye transitions between a predefined vertical angle which defines the zone of accurate elevational eye alignment, and the other displaying a visual change when the azimuth of the sighting eye transitions between a predefined horizontal angle which defines the zone of accurate azimuth eye alignment.

The present invention further provides an apparatus for assisting a shooter in holding an aiming eye at a predetermined proper level relative to the barrel of a shotgun.

The apparatus may comprise means for forming a visual display, and a means for presenting the display to the aiming eye along a path that extends at a predetermined rearward angle over the barrel such that a predetermined longitudinal position of the aiming eye the path is at a proper level for the aiming eye to be held lightly to the barrel, so that in response to being lifted above the path the aiming eye sees a change in image that provides the shooter with a visual indication that the aiming eye has been raised above the proper level relative to the barrel.

In a preferred embodiment, there is an apparatus for assisting a shooter in holding an aiming eye at a proper level relative to a barrel of a shotgun, comprising a light source for mounting at a front sight of the shotgun so as to project a beam of light rearwardly therefrom, and a refractive surface that is mountable to a raised rib on the barrel of a shotgun so as to reflect and diffuse the beam of light into at least first and second different colors divided along a generally horizontal plane extending at a predetermined rearward and upward angle, so that the first color is received by the aiming eye when the aiming eye is below the plane, so as to indicate to the shooter that the aiming is at the proper level relative to the barrel, and the second color is received by the aiming eye when the eye is above the plane, so as to indicate to the shooter that the aiming eye has been raised above the proper level relative to the barrel.

The refractive surface may comprise a diffraction grating, and may be mounted on an inverted U-shaped channel for detachably fitting over and engaging the raised rib on the barrel.

DETAILED DESCRIPTION a. Overview

Figure 1:
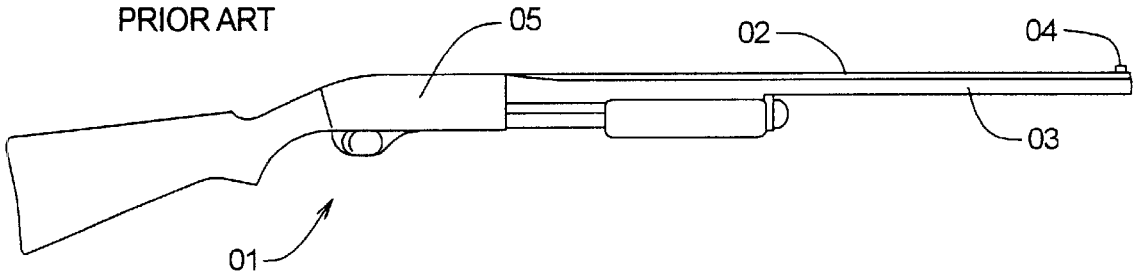
FIG. 1 PRIOR ART
FIG. 1 is an elevational view of a shotgun having conventional rib and bead sights in accordance with the prior art.
Figure 2:
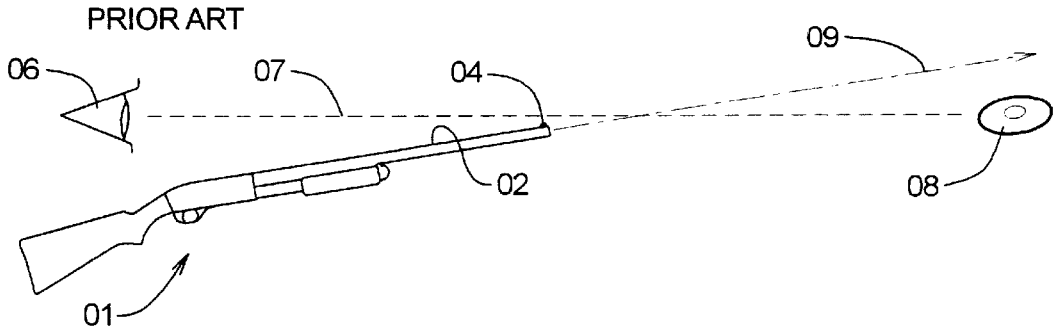
FIG. 2 PRIOR ART
FIG. 2 is an elevational, somewhat schematic view of the shotgun of FIG. 1 and a moving target, showing the manner in which improperly lifting the aiming eye above the level of the rib causes the shot to go high and miss the target.
Figure 3:
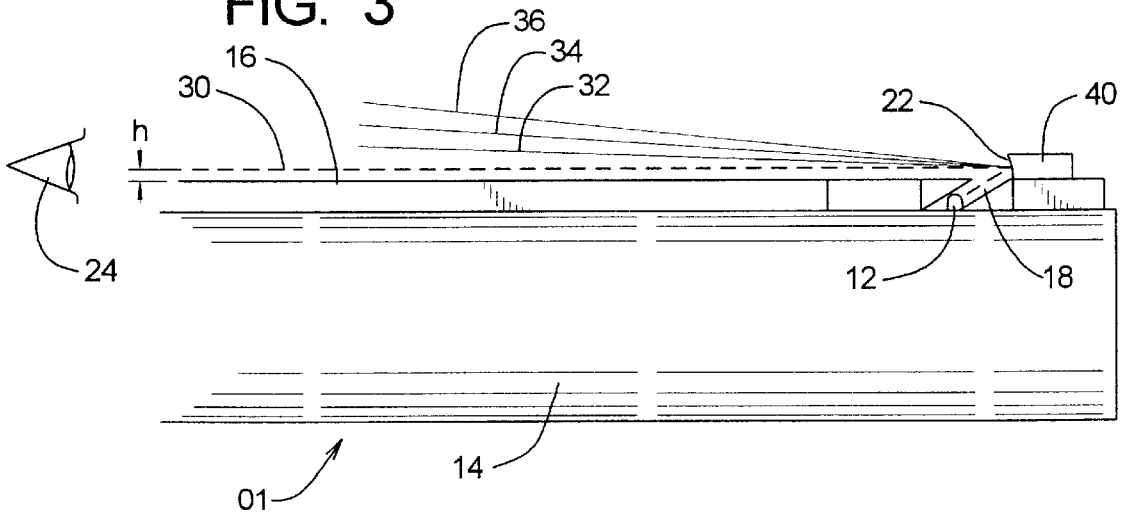
FIG. 3 is a partial, elevational view of the muzzle end of a shotgun having a level indicating system in accordance with the present invention, showing the manner in which a beam of light from an LED or other source is reflected towards the aiming line by a concave diffraction grating on the front sight so that the light appears in bands of color that differ depending on the height of the aiming eye relative to the rib, with one color indicating to the shooter that the eye is at the proper level and the other colors indicating that the eye has been raised too high.

The indicator system of the present invention provides the shooter with an immediate and clearly visible warning when his aiming eye is raised above the proper level relative to the rib of the shotgun. An image is presented to the aiming eye along a path extending at a predetermined rearward and upward angle (in some instances, level with the barrel), such that where the path reaches the longitudinal position corresponding to the location of the aiming eye it is at the proper level for the aiming eye to be positioned relative to the barrel. In the exemplary embodiment which is shown in FIG. 3, this is done by dispersing light into bands of different colors and which are projected rearwardly towards the shooter's aiming eye, so that a first color is visible when the eye is at the proper level, and a different color or colors become visible as the eye is raised above the rib.

As can be seen, the exemplary indicator system 10 includes a battery powered LED 12 or other light source that is mounted at the forward end of the barrel 14, somewhat below the top of the rib 16. The recessed LED is thus blocked from the aiming eye's direct view, but projects a beam of light in a forward and upward direction, through opening 18, towards the rearward face of the front sight 40, which is formed with a concave diffraction grating 22 that is configured to disperse the light into a spectrum and to reflect this back over the top of the rib 16, towards the aiming eye 24.

The spectrum is dispersed in a vertical direction, so that the colors are divided along generally horizontal planes at increasing angles above the barrel. Viewed by the aiming eye, the spectrum therefore appears as presenting different colors depending on the height of the eye relative to the rib 16. For example, the light that is directed along a first angle 30 generally level with the top of the rib 14 may appear pure green, while at progressively higher angles 32, 34, 36 the light may appear, for example, yellow, orange, red, and so on. In this manner when the shooter holds his head in the proper height "h" above the barrel he sees bright green, but if he accidentally lifts his head he will see orange or red, providing a clear and instantaneous warning that the aiming eye needs to be brought back down to the proper level.

Figure 4:
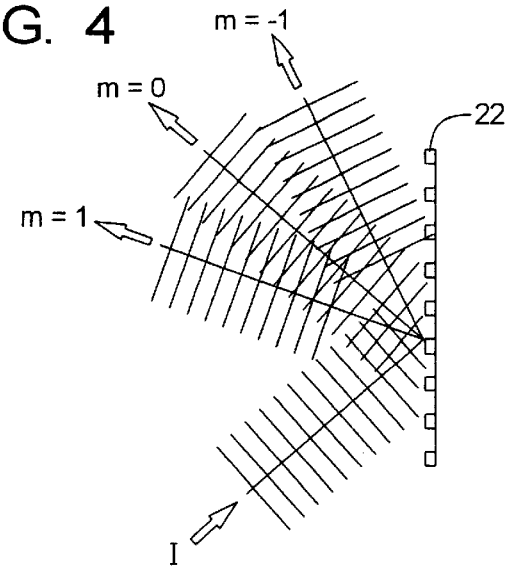
FIG. 4 is an elevational, somewhat schematic view of a diffraction grating such as that used in-the system of FIG. 3, showing the paths of the incident and refracted light in greater detail.

The manner in which a diffraction grating disperses light is well known to those skilled in the relevant art, however, for purposes of better understanding the present invention a summary will be presented here with reference to FIG. 4. As can be seen, the incident light "I" striking the grating is dispersed and reflected in a series of"orders" at differing angles, with the light being dispersed into a separate spectrum within each order. For example, FIG. 4 shows the light reflected in a first order m=1 at a comparatively steep angle to the diffraction grating, and in second and third orders m=0 and m=−1 at progressively shallower angles. This relationship may be expressed as follows:

$$a(\sin\theta_m - \sin\theta_i) = M\lambda$$

wherein "M" is the order, "a" is the spacing of the "teeth" or other segments in the diffraction grating, "λ" is wavelength, "$\theta_i$" is the angle of the incident light, and"$\theta_m$" is the angle of the reflected order.

A diffraction tooth spacing of about 2.5 $\mu$ ($a=0.25\times10^{-5}$) has been found generally suitable for use in the present invention, in that this provides a dispersion of satisfactory width for viewing by the aiming eye. The first order (m=1) is normally the brightest, so that it is generally preferred that this be the order directed towards the aiming eye. Therefore, assuming m=1, the angle at which the colors of the first order will be observed may be expressed as follows:

$$\theta_o = 180\frac{\text{Arcsin}(400000.0000\lambda + \sin(1/180\theta_i\pi))}{\pi}$$

As noted above, each order is dispersed into a separate spectrum of colors. Consequently, a first color may be seen within the order when the eye is at a first level, and other colors are seen as the eye is raised to higher levels. For example, for the aiming eye to see green at a level that lies along path $\theta_o$, $\theta_i$ can be determined based on the above relationship given the known wavelength of green light (approximately 500 m$\mu$). Thus, the correct configuration and angular relationship of the light source and diffraction grating can be determined from a predetermined angle $\theta_o$ at which the path of the green light will intersect the position of the aiming eye at the proper height above the rib.

In FIG. 4 the diffraction grating is shown as being flat for ease of illustrating the relationship described above, however, it will be understood that in the embodiment which is shown in FIG. 3 the diffraction grating is preferably concavely curved so that the light is reflected along an optimal path, level with or at a very shallow angle to the top of the rib 16.

A diffraction grating has the advantage of forming a clear, bright reflection and a comparatively well-defined spectral effect over a comparatively narrow angular range. However, it will be understood that other forms of reflective and refractive surfaces or structures may be employed for this purpose, a number of which will be described in greater detail below. Furthermore, an LED or other light source that emits substantially white light may be used, so as to provide a full spectrum of colors upon dispersion, or the LED or other light source may be configured to emit light only in certain wavelengths, so that only certain colors are reflected and not others. Moreover, the reflective structure may be constructed so that the reflected beam is confined to an angle substantially level with the top of the rib, so that the light is only visible when the aiming eye is at the proper level, or so that the reflected beam lies a spaced distance above the top of the rib, so that the light only appears when the eye is raised to a height above the proper level. Furthermore, the spectrum can be narrowed so as to be more visible to the sighting eye than the opposite (non-sighting) eye so as to inhibit the effect known as cross dominance.

The components of the system may be mounted to the rib or barrel of the shotgun by any suitable means, such as by a magnetic strip, crimping, screws or epoxy or other adhesives, for example, or the components may be constructed as an integral part of the shotgun.

b. Reflective/Diffractive Systems

As was noted above, other forms of reflective and/or diffractive structures may be employed to provide the visible warning to the shooter, in addition to the diffraction grating that has been described above with reference to FIG. 4. Embodiments that utilize a number of these other structures are described below. For ease of illustration, these embodiments are described mainly with regard to versions that employ LED's or other artificial light sources. However, it will be understood that many or all of these structures may also be configured to employ ambient light, which may be preferred in many embodiments due to simplicity, reliability and low cost, as compared with providing an LED or other source of artificial light.

Figure 5:
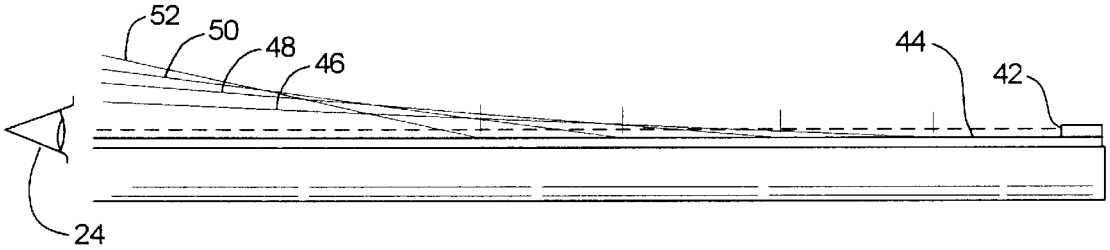
FIG. 5 is a partial, elevational view of a shotgun barrel having a level indicating system in accordance with another embodiment of the present invention, in which light is projected rearwardly from an LED and is reflected by a diffraction grating or a lenticular, lensmatic, holographic or other diffractive surface on the rib so as to form the bands of color viewed by the aiming eye.

Accordingly, FIG. 5 shows another embodiment of the present invention in which light from an LED 42 or other source at the front sight 40 is reflected towards the aiming eye by a reflective/refractive surface 44 that is formed or mounted along the top of the rib itself, rather than on the rearward surface of the front sight.

For example, the reflective/refractive surface 44 may be a diffraction grating similar to that described above, the beam from the LED is divided into different colors that are reflected at increasing angles 46, 48, 50, and 52. Thus, when the aiming eye 24 is held at the proper elevation with respect to the barrel it is in line with the lowest angle of refraction 46, so that the shooter sees a first predetermined color (for example, green), and other colors, are seen as the eye is lifted above the level of the barrel, thereby providing the shooter with a visual warning that his head has been raised above the proper height.

In addition to diffusing light into a spectrum of different colors, the reflective/refractive surface 44 may be configured to produce different or shifting images depending on the position or movement of the aiming eye. For example, the surface 44 may be formed of reflective and transparent layers having overlapping, repetitive lines or patterns that produce a moirè pattern in response to movement of the aiming eye; the moirè pattern may, for example, produce a change in the size and/or shape of the image that is seen by the aiming eye as the eye is raised from its proper position relative to the barrel.

Figure 6:
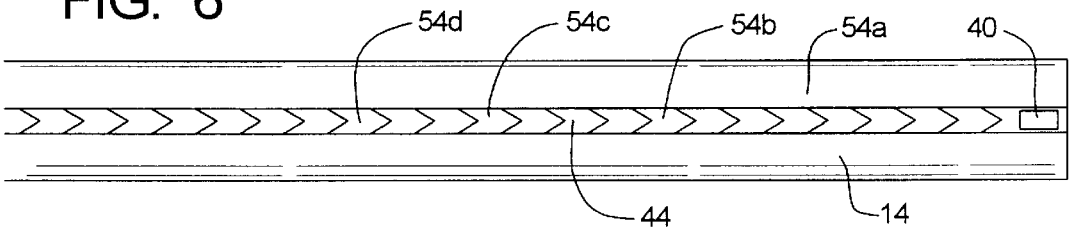
FIG. 6 is a top, plan view of a shotgun barrel similar to that of FIG. 5, showing one manner in which the reflective and/or diffractive surface may be mounted or formed along the top of the rib on the barrel, and also showing one example of a reflective pattern which may be used to produce the illusion of apparent motion, in this instance a progression of arrows that appear to move towards or away from one end of the barrel or the other as the aiming eye is raised or lowered

Still further, as is shown in FIG. 6 the reflective/refractive structure 44 may be formed of a lenticular imaging material that is configured to produce one or more images, or the illusion of apparent motion, depending on the movement and position of the aiming eye. For example, as can be seen in FIG. 6, the lenticular material may be configured to reflect the light at progressively increasing or decreasing angles at a series of locations or segments along its length, such as a series of reflective segments 54 having the appearance of arrows or other suitable shapes. Each arrow (or other shape/segment) is configured to reflect light at a different angle, so that the shooter will see the light from one arrow as his head is raised to a first level, and then the next arrow as the head is raised to a higher level, and so on. For example, as is shown in FIGS. 5 and 6, the light reflected from a first, forwardly located segment 54*a* may be visible when the eye is at a relatively shallow angle 46 to the barrel, and light reflected from segments 54*b*, 54*c*, 54*d* at progressively more rearward locations may become visible as the eye is raised to higher angles 48, 50, 52. The arrows (or other shapes) will therefore appear to move towards one end of the barrel or the other as the head is raised or lowered, giving an impression of motion somewhat analogous to the apparent motion created by airport runway lights.

The lenticular material such as that shown in FIG. 6 may be configured so that the images disappear completely when the eye is held at the proper level relative to the rib, so that only the front bead and/or the light from the LED is visible, or it may be configured so that only a particular image or images are seen. Similarly, if the shooter wishes to intentionally hold his aiming eye at a particular, somewhat elevated level above the rib (as is the case with a few shooters), this can be done by noting which arrow or other segment/shape appears "illuminated" when the eye is at that height; for example if a shooter wishes to hold his aiming eye in a position 3° above the barrel, he can note, for instance, that the third or fourth arrow appears illuminated at this height, and then use this as a visual reference when aiming. The front sight 40 may also be used to form a lenticular pattern to be used independent of, or in conjunction with, the reflective strip 44 described above.

Figure 7A:
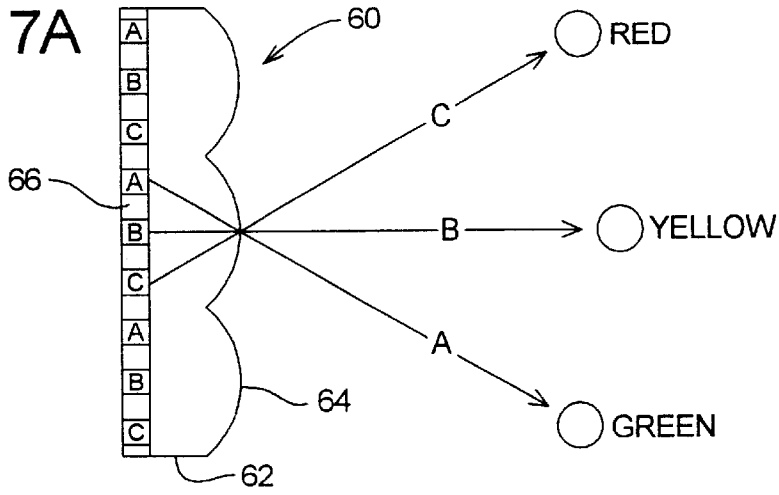
FIGS. 7A and 7B are elevational, somewhat schematic views of a lenticular sheet material, that may be mounted, for example, to the raised rib in a manner similar to that shown in FIG. 6, showing the manner in which the reflected light produces different colors or different images with changes in the angular position of the viewing eye.

The lenticular material may also be configured to create an optical signature that is variable and appears to change in shape and/or color as the position of the viewing eye changes, thereby providing a visual indication that the eye has been moved to or from the proper aiming position. Accordingly, FIG. 7*a* shows a lenticular screen 60 that is used to generate an optical effect that is variable, and therefore visibly noticeable, depending on the angle of view. As is familiar to those skilled in the relevant art, lenticular screens typically comprise plastic sheets 62 with a plurality of repetitive refractive optical elements 64 molded into the surface. Often, these lenses are cylindrical in nature to project different images to the left and right eyes when viewed at normal angles. More generally, such lenticular screens may comprise any of a variety of geometrics, and are not limited to cylindrical, one dimensional angular variability, but can comprise circularly symmetric lenses and so can achieve variability in two dimensions as desirable for the present invention.

When a typical lenticular screen is optically coupled with a printed image 66 with a repeating pattern that is matched to the spatial frequency of the optical elements, either one or the other of the components of the screened pattern is visible, depending upon the angle of view. The distinct positions or stages of the images are referred to as "phases"; for example, the image projected by a "three-phase" lenticular material could change from a red ball to a green ball to a blue one, depending on the angular position of the viewing eye. Common examples can be found in the prismatic lenticular screens often used in children's toys to create a three-dimensional or changing image effect. Lenticular screens of suitable types are available from a wide variety of sources, including, for example, Depthography, Inc., 303 East 44$^{th}$ Street, New York, N.Y. and Micro Lens Technology Inc. 3747 Matthews Indica Road, Matthews, N.C. 28105. Suitable materials for the actual lens sheet include acrylic, which provides a clear image and possesses very good outdoor durability (although its impact resistance is only fair), polycarbonate, which has high impact resistance but also high cost, and PETG (available from Eastman Chemical Company under the brand name "SPECTAR™"), which has excellent clarity, has a high level of impact resistance, and can be made to be highly resistant to UV.

FIG. 7A therefore shows an exemplary lenticular screen 60 employed to perform the optical alignment function of the present invention, in which the components of the screened optical pattern comprise distinct colors, projecting a color signature to the shooter that changes with the angular position of the aiming eye with respect to the gun barrel, therefore providing an optical indication of alignment; for example, as is shown in FIG. 7A, the color green may be seen when the eye is in proper alignment, and yellow and red may be seen at higher angles.

Figure 7B:
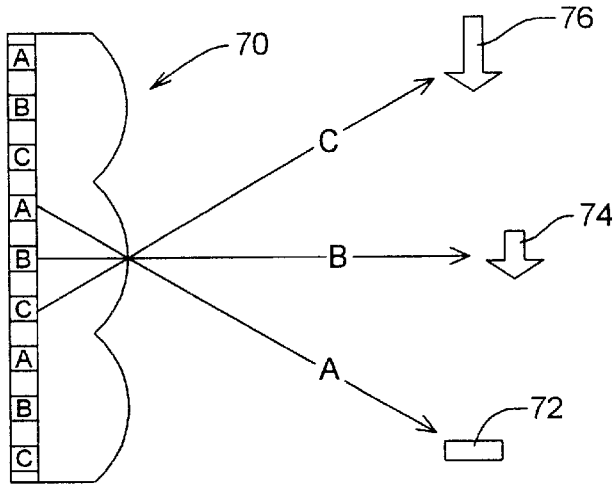

In other embodiments, as is shown in FIG. 7B, different patterns or shapes may be seen at the different angles, with or without changes in color. For example, the lenticular screen 70 may be configured so that a first distinctive image, for example, a bar or line 72, is seen that indicates when the eye is at the proper level relative to the barrel, and second and third, different images are seen as the eye is raised, such as downwardly pointing arrows 74 and 76. In still other embodiments, a continuous gradation in color or intensity of the light may be projected to the shooter, again providing a simple, visual alignment reference.

Figure 8:
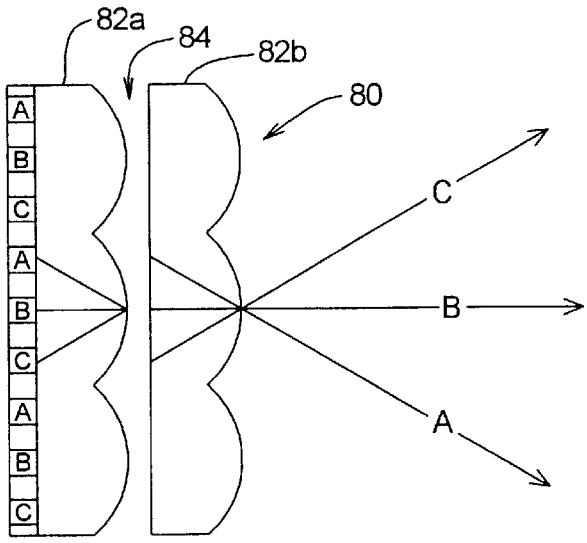
FIG. 8 is an elevational, somewhat schematic view of a pair of superimposed, spaced-apart lenticular sheets, similar to those shown in FIGS. 7A and 7B, which form shifting moirè patterns that are seen with changing positions of the viewing eye.

FIG. 8 shows yet another embodiment of the present invention in which there is a compound lenticular structure 80 having a plurality of lenticular screens 82*a*, 82*b*, preferably two but possibly more, that are superimposed, with a small air gap 84 or a layer of transparent material interposed between them. The resulting optical effect is to generate a moirè pattern because of the repeated nature of the optical elements and their superposition. When viewed at different angles "a", "b", "c", such a superimposed lenticular screen device will project a pattern that resembles the lenticular screen itself, but greatly magnified, and variable depending on small variations in alignment. Again, this alignment sensitive optical signature can serve as a convenient aid to the shooter in attaining accurate alignment of his eye with the gun barrel. For many embodiments it may be advantageous to print the screened optical pattern with transparent, colored dyes, so that substantial amounts of ambient or augmented light will be transmitted through the printed screen, thence through the lenticular screen and directed at the shooter, providing sufficient illumination intensity to operate in daylight conditions.

Figure 9:
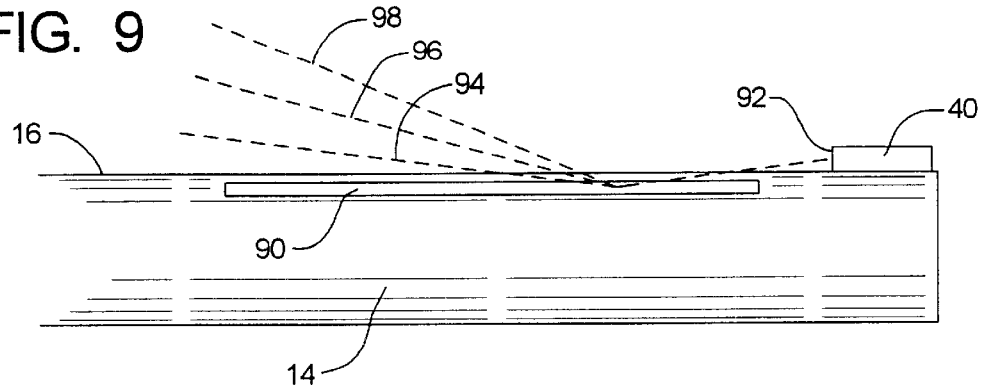
FIG. 9 is a partial, elevational view of the muzzle end of a shotgun having a level indicating system in accordance with another embodiment of the present invention, this being similar to the embodiment in FIG. 5 except that the diffraction grating or other reflective surface is formed or mounted along the barrel itself rather than along the top of the raised rib.

FIG. 9 shows an embodiment of the present invention similar to that described above with reference to FIGS. 3–6, but demonstrating a diffraction grating which is formed as a strip or strips 90 that are adhered to the barrel 14 itself. Light from the LED 92 or other source is reflected and diffused into bands of different color along angled paths 94, 96, 98, in substantially the same manner as described above.

Figure 10:
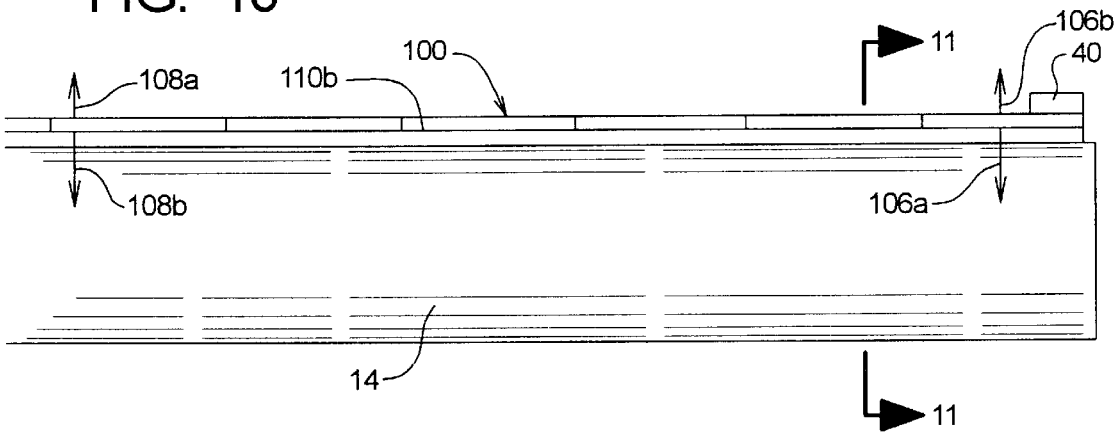
FIG. 10 is a partial, elevational view of the muzzle end of a shotgun having a level indicating system in accordance with another embodiment of the present invention, this having a U-shaped structure that fits over and engages the raised rib on the barrel, with the strips along the sides of the rib being formed of a different color or otherwise contrasting visually with the top of the rib and being angled so as to be visible to the aiming eye only when the eye is raised above the proper level.
Figure 11:
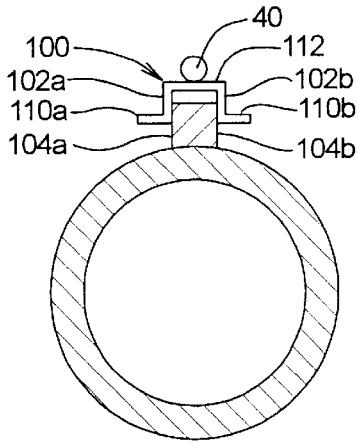
FIG. 11 is a cross-sectional view of the level indicating system of FIG. 10, taken along line 11—11, showing the U-shaped structure and edge strips in greater detail.

FIGS. 10–11 show yet another embodiment, in which the reflective/refractive surface may be formed or mounted on a U-shaped, inverted channel structure 100 which allows the angle of the reflective/refractive surface to be adjusted in order to meet the requirements or preferences of an individual shooter or gun. As can be seen in FIG. 11, the depending side flanges 102*a*, 102*b* fit over and frictionally engage the vertical sidewalls 104*a*, 104*b* of the rib 16. The frictional engagement is preferably sufficiently strong to prevent unintended movement of the channel structure, but at the same time permits a shooter or a gunsmith to selectively slide the channel structure in an up-and-down direction. Thus, as can be see in FIG. 10, the channel 100 and its reflective surface can be angled downwardly by pressing down on the front of the channel and pulling up on the back, as indicated by arrows 106*a* and 108*b*.This allows the shooter to receive the proper visual indication when holding his aiming eye somewhat higher, if desired, so that the gun shoots somewhat higher; conversely, if it is desired for the shooter to hold his eyes lower, the channel member 100 can be tilted down towards the rear, by pressing down in the direction indicated by arrow 108*b* and lifting in the direction indicated by arrow 106*b*.

Although the adjustable U-shape channel structure may be used with any of the reflective/refractive structures that are described herein, in the particular embodiment that is shown in FIGS. 10–11 the U-shaped structure includes first and second side rails 110*a*, 110*b* that extend along the sides of the rib, and that have planar upper surfaces colored to contrast visually with the surface 112 at the top of the rib. For example, the upper surfaces of the side rails may be formed in a bright color, such as fluorescent orange, while the surface at the top of the rib may be an ordinary flat black. The side rails, however, extend at a slight downward angle towards the front of the barrel, so that the upper surfaces of the strips are not visible when the aiming eye is held at the proper level; in other words when the aiming eye is at the proper level it is at or below the plane of the side rails so that the surfaces of the rails cannot be seen. The brightly colored surfaces of the side rails become visible, however, if the aiming eye is lifted above the plane of the rails and therefore above the proper level relative to the barrel, thus providing a clear visual warning to the shooter. In addition, the lower parallel ribs help to keep the aiming eye properly aligned with the long axis of the barrel, or to prevent cross-dominance by the non-aiming eye, since any side-to-side (cast on/cast off) deviation of the eye will cause one of the lower ribs to disappear from view. In addition to having a contrasting color, the side ribs may be formed with a graded color or graded reflectivity/brightness in order to provide the visible indication to the shooter.

Figure 12:
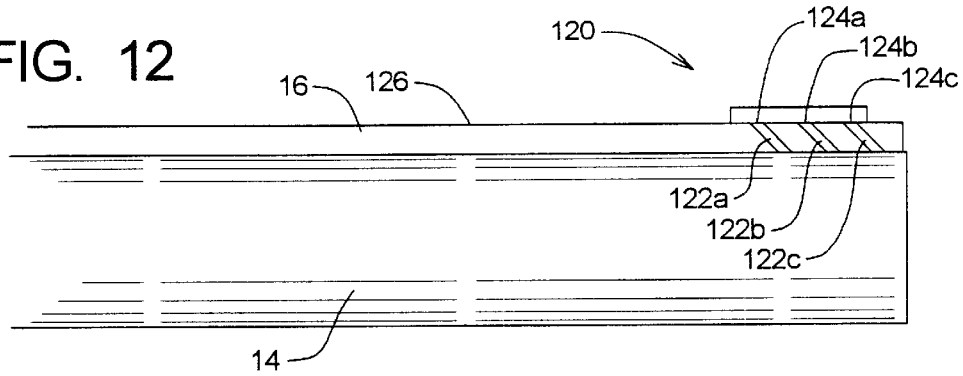
FIG. 12 is a partial, elevational view of the muzzle end of a shotgun barrel having a level indicating system in accordance with another embodiment of the present invention, in which ambient light is gathered by a plurality of rearwardly angled fiber optic rods, with the end surfaces of the rods lying generally level with and parallel to the top of the rib so that the light projected from the ends of the rods is only seen when the eye is raised above the proper level.

FIG. 12 shows another embodiment having a visual indicator so that cannot be seen until the eye is raised above the proper level. In this embodiment the alignment structure 120 includes one or more light-gathering fiber optic tubes or rods 122*a*, 122*b*, 122*c* that are mounted alongside the rib 16. The fiber optic rods serve to collect ambient light, which is projected at increased brightness from the ends of the rods. The upper end surfaces 124*a*, 124*b*, 124*c* of the rods are approximately level with the top of the rib 16, and are formed to extend substantially parallel to the upper surface 126 of the rib.

As a result, the aiming eye sees little or no light from the fiber optic rods when it is level with the top of the rib, but as the eye is raised above the level of the rib the end surfaces 126 of the rods come into view, so that the light projected from the rods becomes visible. In the embodiment which is illustrated, the rods are angled in a rearward and upward direction, so that as the aiming eye is raised it moves closer to axial alignment with the rods so that the light is seen as becoming increasingly bright, thereby providing the shooter with an increasingly strong warning that his head is being lifted above the proper level. In addition, the angled alignment of the rods increases the length of each rod that is exposed to ambient light (as opposed to a vertical arrangement), while keeping the rods sufficiently compact to be mounted in the available space between the top of the barrel and the upper surface 126 of the rib. The rods may be fixedly mounted to the sides of the rib and/or the barrel, or they may be pivotably mounted and the assembly may include an adjustment screw or other mechanism for adjusting the angle of the rods according to the shooter's preference. The rods may also be formed of a fluorescent material as well as the fiber optic tubes described above, and in some embodiments the ends of the rods may be angled somewhat more towards or away from the shooters, rather than being parallel to the top surface of the rib as shown.

Figure 13:
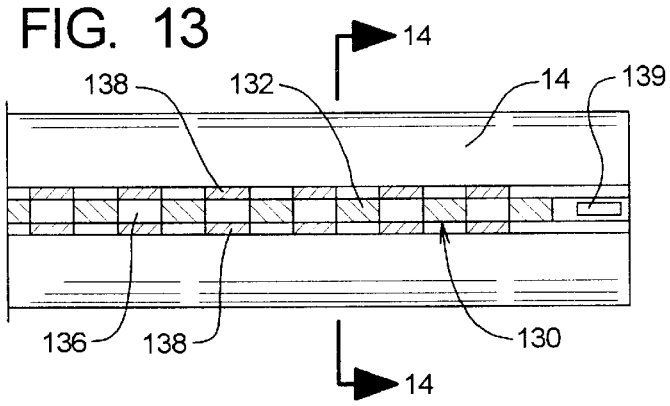
FIG. 13 is a top, plan view of the muzzle end of a shotgun-barrel having a level indicating system in accordance with another embodiment of the present invention, in which the refractive/reflective surface is formed on a channel structure that fits over the rib in a manner similar to that shown in FIGS. 10–11, with contrasting reflective patterns being formed on the top and side strips so as to present contrasting visual patterns as the aiming eye is raised above the proper level.
Figure 14:
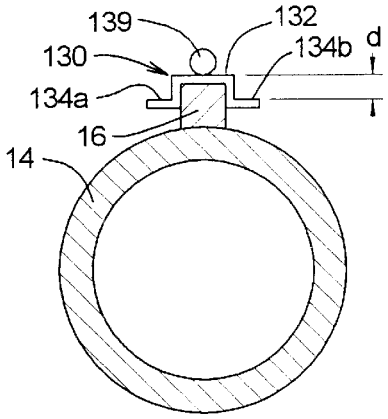
FIG. 14 is a cross-sectional view of the level indicating system of FIG. 13, taken along lines 14—14, showing the configuration of the reflective surfaces in greater detail.

FIGS. 13–14 illustrate an embodiment of the invention that is somewhat similar to that shown in FIGS. 10–11 in that it includes a U-shaped channel structure 130. In this instance, however, there is a primary reflective/refractive surface 132 that extends along the top of the rib 16, and secondary reflective surfaces 134*a*, 134*b* that extend along the side rails parallel to the reflective surface 132, but at a spaced distance "d" below than the primary surface. The primary and secondary surfaces are formed with contrasting reflective patterns that are offset by a predetermined distance along the length of the barrel. For example, in the embodiment that is shown in FIGS. 13–14, the primary and secondary surfaces are formed with a pattern of alternating reflective and non-reflective surfaces that are offset so that reflective segments 136 on the primary surface are bordered by non-reflective segments 138 on the side rails, and vice versa. An LED 139 or other light source projects a beam of light rearwardly onto both the primary and secondary reflective surfaces, however, due to the difference "d" in height between the two surfaces, the light is reflected along different paths, so that the relationship between the segments will appear to shift with changes in the angular position of the aiming eye. This shift is perceived as a change in the reflected pattern produced by the primary and secondary surfaces, thereby providing the shooter with an indication that the aiming eye has been raised above the proper level relative to the barrel. Lenticular, holographic, and lensmatic surfaces can be mounted or formed on the primary and secondary surfaces as well.

Figure 15:
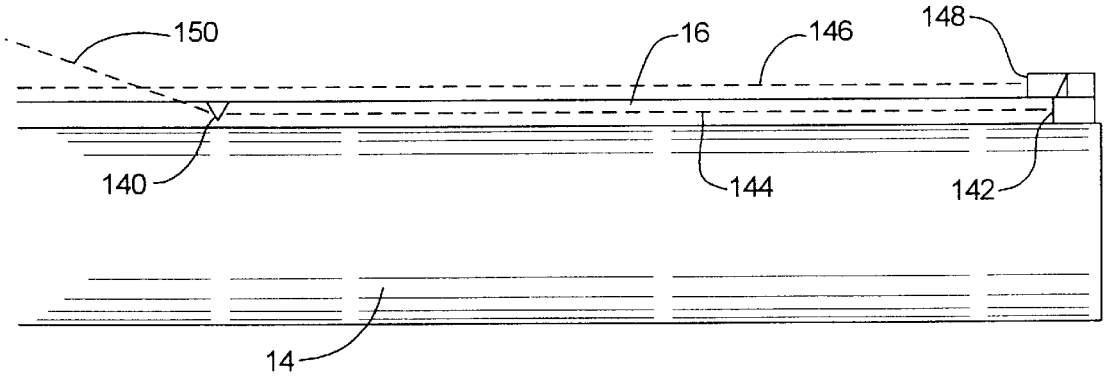
FIG. 15 is a partial, elevational view of the muzzle end of a shotgun barrel having a level indicating system in accordance with another embodiment of the present invention, in which light which is projected from the LED or other source is diffracted into bands of different color by a prism, rather than by a diffraction grating as in FIGS. 3 and 4.

FIG. 15 shows an embodiment of the invention that employs a prism 140 rather than a reflective surface to diffuse the light, with the prism being mounted somewhat below the level of the rib 16. A beam of light is directed rearwardly against the prism from an LED 142 or other light source, along a path 144 that lies below the line of sight 146 from the aiming eye to the front bead 148. As a result, the light is not visible until the eye is raised to a level where it is in the path of the refracted light 150. This permits the shooter to use the sights in a conventional manner, and the visual warning is only seen when the head is raised above the proper level. The prism 140 may be mounted alongside the rib, or in a passage within the rib through which light is projected from the LED, with the refracted light exiting through a suitable opening or window. In some embodiments a somewhat similar arrangement may be used with a diffraction grating or other refractive structure in place of the prism.

Figure 16:
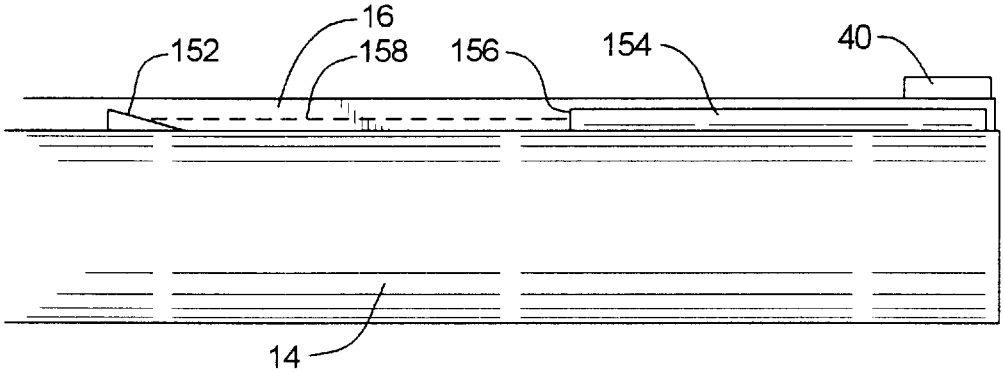
FIG. 16 is a partial, elevational view of the muzzle end of a shotgun barrel having a level indicating system in accordance with another embodiment of the present invention, in which ambient light is gathered by a fiber optic tube and projected rearwardly therefrom onto an angled mirror that directs the beam on the path towards the aiming eye.

The embodiment shown in FIG. 16 employs a mirror 152 mounted alongside the rib 16 to reflect the beam of light towards the aiming eye. Rather than diffusing the light, the mirror reflects the beam along a predetermined rearward and upward angle, with the lower part of the reflected beam being cut off from view so that the beam is only visible when the aiming eye is raised above the proper level. Alternatively, the mirror surface can be configured so that the upper part of the reflected beam is blocked or otherwise cut off, so that the light is only seen when the aiming eye is held at the proper level, and then disappears as the eye is raised.

In addition, the embodiment that is shown in FIG. 16 employs a light source in the form of one or more fiber-optic rods rather than an LED or other battery-powered source. The fiber-optic rod 154 gathers ambient light, with the clear end 156 of the rod being disposed towards the angled mirror 142. Light is thus projected rearwardly from the end of the fiber-optic rod along path 158, and then reflected towards the aiming eye in the manner described above. A fiber-optic light source may also be used in combination with a diffraction grating, prism, or any of the other reflective/refractive surfaces and structures that are described herein.

Other sources, structures and devices may occur to those skilled in the art that may be employed in accordance with the present invention to project an image or a beam of light along a predetermined rearward angle so as to provide the shooter with a visual warning when his aiming eye is raised above the proper level. For example, although the reflective and refractive structures that have been described above have numerous advantages in terms of distinctness, clarity, and so on, in some embodiments the beam of light may be projected directly from a source towards the aiming eye rather than being reflected or diffracted, or may be masked off or otherwise configured so as to be only visible when the eye is raised above the proper level, or vice versa. For example, a beam of light may be projected through a colored panel or lens that divides the beam into different colors and projects it at the desired angle towards the aiming eye. Still further, other suitable forms of refractive and/or reflective surfaces and structures may occur to those skilled in the art, including lensmatic structures, for example.

Moreover, the various light sources and reflective/refractive surfaces and structures may be employed interchangeably, depending on the intended use of the system, expected ambient light conditions, and other factors. For example, either an LED or a light-gathering fiber-optic rod may be employed with a prism, diffraction grating or lenticular screen to produce the desired images and patterns.

Furthermore, it will be understood that the systems of the present invention may be configured to aid the shooter in maintaining alignment in azimuth, in addition to or in place of elevation as described above. For example, the structures described above may be configured so that the visual indication changes with changes in the lateral position of the eye. Thus, with regard to the problem of cross-dominance, the non-aiming eye will see an image different from the aiming eye (when the latter is properly aligned with the barrel), immediately alerting the shooter so that he can concentrate on the aiming eye.

c. Dual Plane Alignment Systems

Various forms of reflective and/or diffractive structures have been illustrated above which provide a visual indication as to whether the eye is properly aligned with the barrel 14 of the gun. In accordance with these illustrated examples additional embodiments are described below which conjunctively provide an indication of elevational and azimuth alignment using principles described in the preceding discussions.

Figure 19:
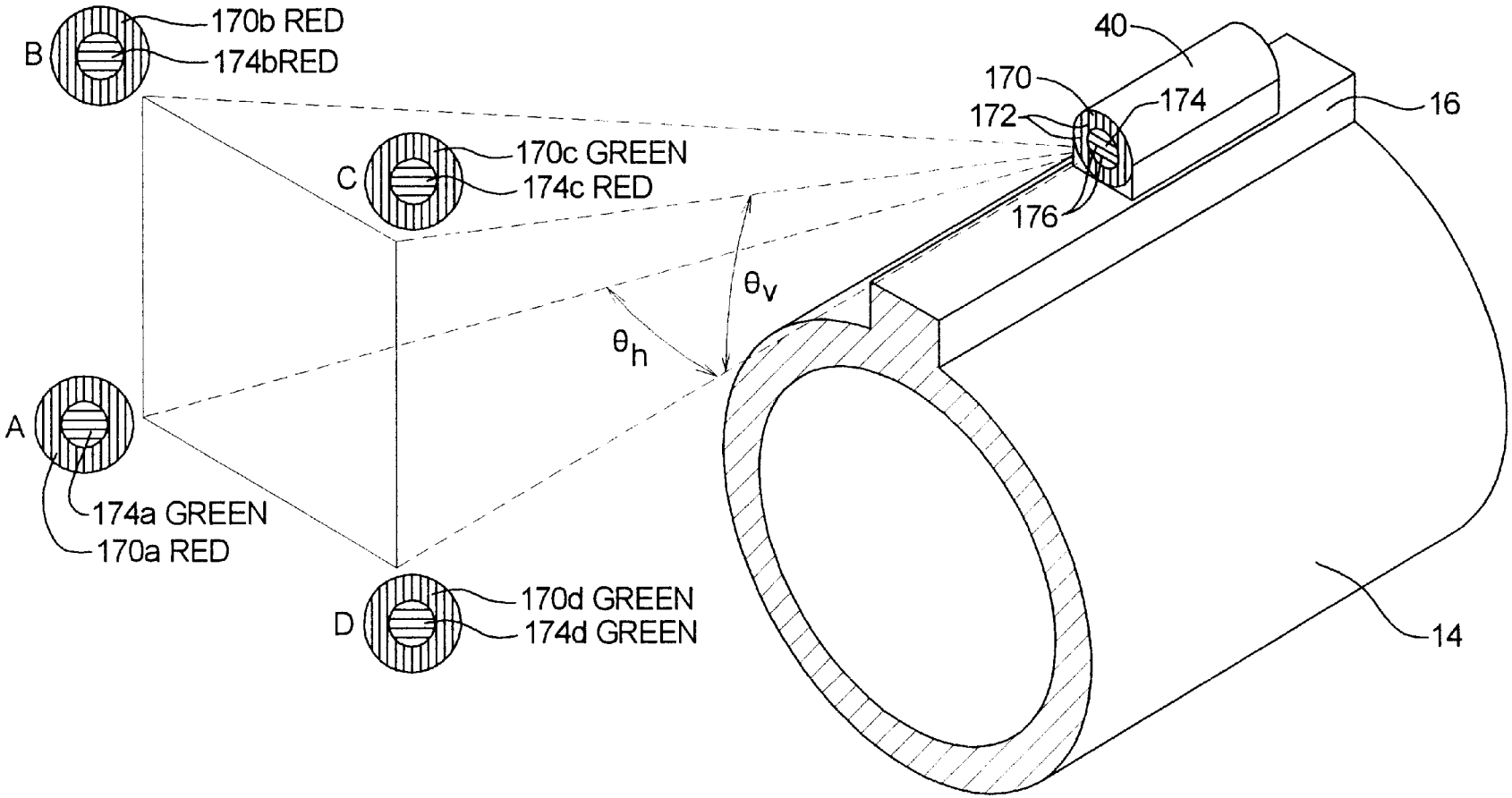
FIG. 19 is an isometric view of a muzzle end of a shotgun barrel having both a level and an azimuth indicating system in accordance with another embodiment of the present invention, comprising two concentric, orthogonally oriented circles of lenticular material on the front sight, one which displays a color change when the viewing eye transitions within a prescribed horizontal angle with the shotgun barrel, and one which displays a color change when the viewing eye transitions within a prescribed vertical angle with the shotgun barrel.

In one preferred embodiment, illustrated in FIG. 19, a first, substantially planar circle of lenticular material 170 is mounted to the rearward face of the front sight or bead 40 using adhesives, magnets, or other connective means that are either fixed or adjustable for angle and position. The array of cylindrical lenses 172 forming the optical surface of the lenticular material 170 is aligned in a predominately vertical direction providing a variable visual display as the azimuth of the shooter's sighting eye adjusts during aiming. Preferably a two-phase lenticular material is used comprising interleaved images of color such as red and green, and the material is configured to display a visual color change when the azimuth of the sighting eye transitions between a predefined horizontal angle (approx. 2–3 degrees, for example)

which defines the zone of accurate azimuth eye alignment along the angular path defined by oh. For example, as illustrated in FIG. 19, when the shooter's eye is outside the prescribed angle, at positions "A" or"B", the circular display 170*a*, 170*b* will appear red indicating improper alignment, and when the shooter's eye is within the prescribed angle, at positions "C" or"D", the circular display 170*c*, 170*d* will appear green indicating accurate azimuth alignment.

A second, smaller, circle of lenticular material 174 is concentrically mounted to the first 170 with its cylindrical lenses 176 aligned in a predominately horizontal direction. By this alignment, the inner circle 174 is configured to display a visual color change when the elevation of the sighting eye transitions between a predefined vertical angle (approx. 2–3 degrees for example) which defines the zone of accurate elevational eye alignment along the angular path defined by θv. For example, as illustrated in FIG. 19, when the shooter's eye is outside the prescribed angle, at positions "B" or "C", the circular display 174*b*,174*c* will appear red indicating improper alignment, and when the shooter's eye is within the prescribed angle, at positions "A" or "D", the circular display 174*a*,174*d* will appear green indicating accurate elevational alignment.

By incorporating similar lenticular materials on each display circle 170,174, but orienting their cylindrical lenses 172,176 normal to each other, an indication of both azimuth and elevational alignment can be ascertained simultaneously. When the inner circle 174 appears red (positions "B", "C"), elevation must be adjusted, when the outer circle appears red (positions "A", "B"), azimuth must be adjusted, and when both circles appear green (position "D"), the eye and barrel rib 16 are both horizontally and vertically aligned for accurate aiming.

Due to the low cost and simple adaptation, the illustrated embodiment uses a concentric arrangement of separate lenticular circles 170,174 oriented normal to each other. However, a similar effect may be achieved by using a single circle of appropriately configured lenticular material having either orthogonal arrays of cylindrical lenses or a two dimensional array of spherical lenses (fisheye). By these configurations, the single circle will appear red when misaligned in either direction and green when fully aligned.

Figure 20:
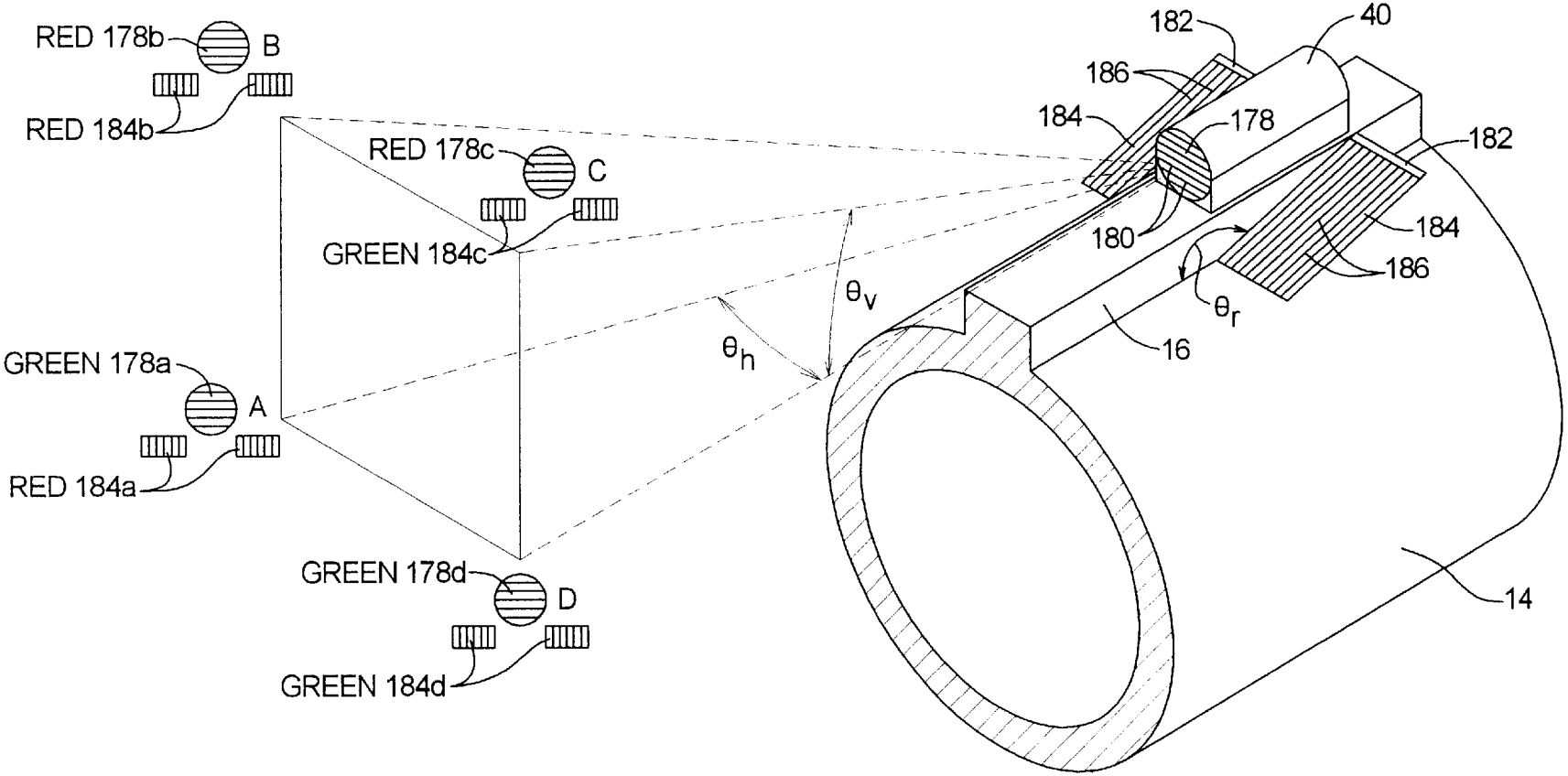
FIG. 20 is an isometric view of a muzzle end of a shotgun barrel having both a level and an azimuth indicating system in accordance with another embodiment of the present invention, comprising a circle of horizontally oriented lenticular material on the front sight, which displays a color change when the viewing eye transitions within a prescribed vertical angle with the shotgun barrel; and a set of angled tabs, opposingly mounted adjoining the front sight and comprising a lenticular surface, orthogonally oriented with respect to the lenticular circle, which displays a color change when the viewing eye transitions within a prescribed horizontal angle with the shotgun barrel.

FIG. 20 shows another embodiment providing simultaneous indicative means for azimuth and elevational alignment. In this example, as in the previous embodiment, a substantially planar circle of lenticular material 178 is mounted to the rearward face of the front sight 40 using similar connective means. In this case, the array of cylindrical lenses 180 forming the optical surface of the lenticular material is aligned in a predominately horizontal direction, providing the user with an indication of elevational alignment accuracy as defined by angle θv. A similar color scheme may be used as in the previous embodiment, and accordingly, when the eye is vertically misaligned with the barrel rib 16, as shown in positions "B" and"C", the circle 178*b*, 178*c* appears red; and when vertical alignment has been achieved, as shown in positions "A" and "D", the circle 178*a*,178*d* appears green.

For azimuth alignment, a pair of laterally extending, substantially planar, rectangular tabs 182 are opposingly mounted, by fixed or adjustable means, to either side of the rib 16 adjoining the sight bead 40. The tabs 182 are angled (θr) such that the top surface faces upward and rearward towards the shooter, and a lenticular material 184, similar to that affixed to the site bead 40, is applied to this upper surface such that its cylindrical lenses 186 are aligned substantially normal to the lateral axis of the barrel 14. The lenticular material is conjunctively configured with respect to the incline angle θr of the side tabs 182, such that the rearward facing projection of the lenticular material 184 provides a visual indication whether azimuth alignment has been achieved. When the horizontal angle (θh) of the eye with respect to the barrel rib 16 is misaligned, as shown in positions "A" and "B", the lenticular tab projections 184*a*, 184*b* appear red; and when horizontal alignment has been achieved, as shown in positions "C" and "D", the lenticular tab projections 184*c*, 184*d* appear green.

At position "D" both the circle 178*d* and lenticular tab projections 184*d* appear green indicating full sight alignment.

By this configuration, as opposed to the concentric circle arrangement of the previous embodiment, a substantially larger indicator surface is presented to the shooter. And, although the azimuth alignment tabs 182 may be oriented at various angles θr (including a right angle) with respect to the horizontal plane of the barrel rib 16, by inclining the tabs at a highly obtuse angle, their exposure to ambient light is increased, providing better visibility for the shooter.

Although these exemplary embodiments utilize substantially planar, and geometrically specific lenticular structures, it is expected that those of ordinary skill in the art will apply structures of various geometric shapes and various degrees of curvature (concave, convex, etc.) to achieve similar or enhanced effects. Furthermore, the alignment indication colors may be changed, and/or shapes or indicia may be added to the interleaved images to provide different visual effects. Still further, the phase of the lenticular material may be increased to provide a gradated visual image which continually varies as the angle of alignment varies.

In typical applications the described embodiment is intended to operate in the presence of ambient light, however, artificial illumination, such as an LED, may be provided to enhance the visibility of the display during low light conditions. Furthermore, a diffraction grating may be substituted for the lenticular material, in which case an artificial light source may be especially beneficial.

d. Lead Gauge

Figure 17:
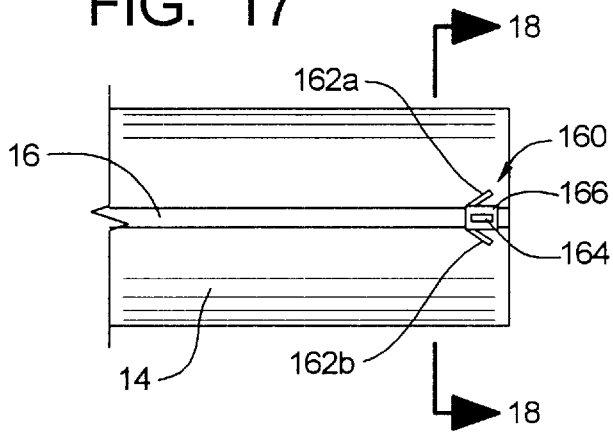
FIG. 17 is a top, plan view of a muzzle end of a shotgun barrel having a visual reference structure in accordance with another embodiment of the present invention, in which there are outwardly-angled lead rods projecting on either side of a central bead for aligning the barrel relative to the line of flight of a target.
Figure 18:
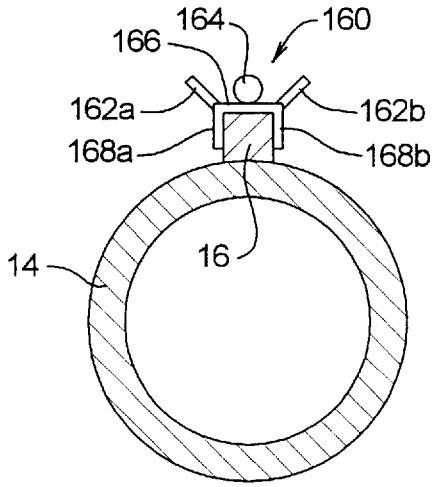
FIG. 18 is a cross-sectional view of the visual reference structure of FIG. 17, taken along line 18—18, showing the angulations of the lead rods and their relationship to the central bead in greater detail.

FIGS. 17–18 show a front sight assembly in accordance with an embodiment of the present invention, which includes a lead gauge for assisting the shooter in aligning the barrel with the projected line of flight of the target. This assembly may be used in combination with one or another of the alignment aids described above, or may be mounted at the front sight of a shotgun as a separate accessory.

As can be seen, the lead gauge assembly 160 includes first and second lead rods 162*a*, 162*b* which extend outwardly on either side of the bead 164 or other axial sight. The rods extend in opposite directions at an angle of approximately 45° to vertical, as defined by the relationship of the bead to the barrel 14. The 45° angle thus indicated by each of the rods provides the shooter with a perspective on the angle of the flight of the target, thereby assisting the shooter in rapidly acquiring the target and properly leading the shotgun along the line of flight; the 45° angle has been found optimal for most applications, however, in some embodiments, the angle of the rods may be configured to be adjustable to suit individual preference or particular application. The length of the rods, in turn, may be selected to provide the shooter with a visual approximation of the shot pattern, and therefore help the shooter both in aiming and determining the distance by which the target should be led.

In the preferred embodiment that is illustrated, the lead rods 162*a*, 162*b* are mounted with the bead 164 on a short section of inverted U-shaped channel 166. The depending flanges 168*a*, 168*b* (see FIG. 18) of the U-shaped channel fit over and frictionally engage the sidewalls of the rib 16 in a manner similar to that described above, which allows the assembly to be easily mounted atop the rib, and also allows it to be adjusted by sliding it forwardly or rearwardly along the rib, depending on which tube is being used in the shotgun. In other embodiments, however, the assembly 160 may be fixedly mounted at the muzzle end of the barrel, or may be provided with other means of adjustment.

Although the short, comparatively thin rod members 162*a*, 162*b* that are shown in FIGS. 17–18 form an excellent sight picture, giving the shooter an indication of the line of flight without interfering with the view and use of the front bead, it will be understood that other angled structures may be used for this purpose, such as angled blade structures, for example.

It is to be recognized that these and various other alterations, modifications, and/or additions may be introduced into the constructions and arrangements of parts described above without departing from the spirit or ambit of the present invention as defined by the appended claims.

What is claimed is:

1. An apparatus for assisting a shooter in holding an aiming eye at a predetermined proper position relative to a barrel of a shotgun, said apparatus comprising:

a first lenticular element mounted to a forward portion of said barrel so that a first image is received by said aiming eye when in proper alignment with said barrel in elevation and a second image is received by said aiming eye when moved vertically out of said proper alignment in elevation; and a second lenticular element mounted to a forward portion of said barrel in substantially orthogonal relationship to said first lenticular element so that a third image is received by said aiming eye when in proper alignment with said barrel in azimuth and a fourth image is received by said aiming eye when moved laterally out of said proper alignment in azimuth;

so that in response to being moved out of proper alignment in either azimuth or elevation said aiming eye sees a change in image that provides said shooter with a visual indication that said aiming eye is not in said predetermined proper position relative to said barrel.

2. The apparatus of claim 1, wherein said first and second lenticular elements each comprise a substantially planar layer of lenticular sheet material mounted to said barrel.

3. The apparatus of claim 1, wherein said first and second lenticular elements are mounted in substantially co-located relationship on a front bead on said barrel of said shotgun.

4. The apparatus of claim 3, wherein said first and second lenticular elements are arranged in generally concentric relationship on a rearward side of said bead.

5. The apparatus of claim 1, wherein said first lenticular element is mounted on a front bead on said barrel of said shotgun, and said second lenticular element is mounted on each side of a rib on said barrel proximate said bead.

6. The apparatus of claim 1, wherein said first and third images are a first matching color.

7. The apparatus of claim 6, wherein said second and fourth images are a second matching color.

8. The apparatus of claim 7, wherein said first matching color is green and said second matching color is green.

* * * * *